US012357922B1

(12) United States Patent
Zou

(10) Patent No.: US 12,357,922 B1
(45) Date of Patent: Jul. 15, 2025

(54) MODEL-MAKING TOY CAPABLE OF STEPPING OUT 3D MODELS

(71) Applicant: Chunliang Zou, Guangzhou (CN)

(72) Inventor: Chunliang Zou, Guangzhou (CN)

( * ) Notice: Subject to any disclaimer, the term of this patent is extended or adjusted under 35 U.S.C. 154(b) by 0 days.

(21) Appl. No.: 19/022,350

(22) Filed: Jan. 15, 2025

Related U.S. Application Data

(63) Continuation-in-part of application No. 18/910,765, filed on Oct. 9, 2024.

(51) Int. Cl.
*A63H 33/32* (2006.01)
*A43B 13/14* (2006.01)
*A63H 5/00* (2006.01)
*A63H 33/00* (2006.01)

(52) U.S. Cl.
CPC ..... *A63H 33/001* (2013.01); *A43B 13/14* (2013.01); *A63H 5/00* (2013.01)

(58) Field of Classification Search
CPC ..... A63H 33/32; A43B 3/24; A43B 3/246
USPC ..... 446/70
See application file for complete search history.

(56) References Cited

U.S. PATENT DOCUMENTS 3,538,628 A * 11/1970 Einstein, Jr. ..... A43B 3/0078 36/15
4,958,446 A * 9/1990 Brown ..... A43B 3/0078 36/1
5,331,753 A * 7/1994 Rodibaugh ..... A43B 13/00 40/636
5,586,501 A 12/1996 Burguera et al.
5,980,351 A * 11/1999 McCook ..... A43B 3/0026 36/15
6,080,033 A * 6/2000 Fladwood ..... A43B 3/00 101/103
6,497,056 B1 * 12/2002 McGoveran ..... A43B 23/24 36/1
8,075,456 B2 * 12/2011 Fugitt ..... A63B 21/4015 482/92
D675,410 S * 2/2013 Day, Jr. ..... D2/951
D734,007 S * 7/2015 Osiol ..... D2/951
9,687,043 B2 * 6/2017 Kenney ..... A43B 13/22
2002/0166258 A1 * 11/2002 Posa ..... A43B 1/0072 36/15
2005/0120589 A1 * 6/2005 Coomes ..... A43B 13/30 36/15

(Continued)

OTHER PUBLICATIONS

U.S. Appl. No. 18/910,765—Non-final Office Action mailed on Dec. 3, 2024, 6 pages.

(Continued)

*Primary Examiner* — Kurt Fernstrom
(74) *Attorney, Agent, or Firm* — Getech Law LLC; Jun Ye

(57) ABSTRACT

The present disclosure belongs to the technical field of toys and claims a model-making toy capable of stepping out 3D models, comprising a toy sole body, wherein an upper surface of the toy sole body is provided with a tread surface. When a user walks or plays in snow, he/she can step out 3D models of various shapes through simple foot movements, thus increasing fun and interaction of snow activities. Through the cooperation of the liquid inlet, the pigment storage cavity and the connecting through hole, it is convenient to add pigments to the model, so that the formed 3D model is more vivid and interesting.

17 Claims, 17 Drawing Sheets

(56) References Cited

U.S. PATENT DOCUMENTS

| | | | | |
|---|---|---|---|---|
| 2005/0189084 | A1* | 9/2005 | Bitton | A63H 33/32<br>164/109 |
| 2017/0150779 | A1 | 6/2017 | Walker et al. | |
| 2019/0000177 | A1 | 1/2019 | Dervish et al. | |

OTHER PUBLICATIONS

U.S. Appl. No. 18/910,765—Notice of Allowance mailed on Feb. 20, 2025, 7 pages.

* cited by examiner

MODEL-MAKING TOY CAPABLE OF STEPPING OUT 3D MODELS

INCORPORATION BY REFERENCE

This application is a Continuation in part of U.S. application Ser. No. 18/910,765, filed Oct. 9, 2024. The entire contents of which are incorporated herein by reference.

TECHNICAL FIELD

The present disclosure belongs to the technical field of toys, in particular to a model-making toy capable of stepping out 3D models.

BACKGROUND ART

With the progress of our society and the improvement of people's living standards, consumers are increasingly demanding for experiencing outdoor activities in winter. They are no longer satisfied with such basic needs as warmth, anti-slip and comfort, but start to pursue more entertainment and creative elements, so as to obtain a richer and more diverse experience in outdoor activities. Especially in family trips, friends gatherings and other scenarios, a snowshoe product that can add interactive fun and stimulate creativity is particularly important. In this context, there are many innovative products on the market that try to combine entertainment with snowshoes, such as snowshoes with light-emitting devices and ski shoes with music playing adjustable. These products meet the new demand of users for outdoor activities to a certain extent, but still do not allow users to directly interact with snow through the soles and create personalized 3D models.

At present, there is no sole product on the market that can directly press out and retain a 3D model in snow. For the purpose of such products, the sole material shall have sufficient wear resistance, slip resistance and deformation recovery ability, an exquisite structural design is needed to realize unique interaction between users and snow. Moreover, given the variability and uncertainty of outdoor activities, these products also need to meet high standards in terms of durability, ease of use and safety. Therefore, the present disclosure aims to fill in this market gap and realize the function of users freely creating 3D models in snow through an innovative sole design, thus adding new fun and creativity to snow activities.

SUMMARY

In order to address challenges presented in the above background art, the present disclosure proposes a model-making toy capable of stepping out 3D models, which is combined with traditional winter shoes and brings unprecedented interactive experience and creative fun to users.

In order to achieve the above purpose, the present disclosure provides the following technical solutions: A model-making toy capable of stepping out 3D models, comprising a toy sole body; an upper surface of the toy sole body is provided with a tread surface and a bottom surface thereof is provided with a ground-touching surface; the ground-touching surface is provided with a 3D molding groove; the toy sole body is provided with a connecting structure for assembling the model-making toy to a shoe bottom.

Preferably, the tread surface is integrally formed with a plurality of friction beans, and the friction beans are arranged at intervals on the tread surface.

Preferably, the connecting structure comprises a blocking protrusion arranged on the tread surface, and the blocking protrusion is provided with a tape threading hole.

Preferably, the blocking protrusion comprises a first protrusion located at one end of the toy sole body and two second protrusions located at the other end of the toy sole body. The first protrusion is provided with a first tape threading hole, and the second protrusion is provided with a second tape threading hole.

Preferably, the ground-touching surface is provided with a group of friction grooves which are arranged at intervals on the ground-touching surface.

Preferably, the interior of the toy sole body is provided with a pigment storage cavity, and the 3D molding groove is provided with a connecting through hole that communicates with the pigment storage cavity.

Preferably, the tread surface is provided with a flow guiding slope, and the flow guiding slope is provided with a liquid inlet connected to the pigment storage cavity.

Preferably, a pressure sensing unit and a sounding unit are arranged inside the toy sole body for sounding to remind that the 3D model has been molded.

A second aspect of the present application provides a method for stepping out 3D models, which is applied to the above-mentioned model-making toy capable of stepping out 3D models. The method comprises the following steps of: abutting step: abutting the 3D molding groove against a molding material; molding step: applying a molding pressure to the tread surface and moving the sole body toward a molding material to make the molding material form a model in the 3D molding groove; and demolding step: moving the sole body away from the molding material to expose the model.

Preferably, the molding step comprises a shaping step and a pressing step; in the shaping step, a force is applied to the tread surface, and the sole body moves toward the molding material so that the molding material is filled into the 3D molding groove; in the pressing step, a force is continuously applied to the tread surface so that the 3D molding groove presses the molding material to form a model.

Preferably, a pigment storage cavity is arranged inside the toy sole body, and the pressing step further comprises a coloring process in which the pigment storage cavity adds pigment to the model.

Preferably, the toy sole body is provided with a pressure sensor and a sounding unit; the pressure sensor is used for detecting the value of the molding pressure, and when the value of the molding pressure is greater than a set threshold, the sounding unit emits a warning sound.

A third aspect of the present application provides a model-making toy capable of stepping out 3D models, comprising a toy sole body; an upper surface of the toy sole body is provided with a tread surface and the sole body is provided with a 3D molding protrusion on a side opposite to the tread surface; the toy sole body is provided with a connecting structure for assembling the model-making toy to a shoe bottom.

Preferably, the connecting structure comprises a blocking protrusion arranged on the tread surface, and the blocking protrusion is provided with a tape threading hole.

A fourth aspect of the present application provides a method for stepping out 3D models, which is applied to the above-mentioned model-making toy capable of stepping out 3D models. The method comprises the following steps of: abutting step: abutting the 3D molding groove against a molding material; molding step: applying a molding pressure to the tread surface and moving the sole body toward a molding material to make the 3D molding protrusion form a model in the molding groove; and demolding step: moving the sole body away from the molding material to expose a model.

Preferably, the molding step comprises a shaping step and a pressing step; in the shaping step, a force is applied to the tread surface, and the sole body moves toward the molding material so that a 3D molding protrusion is embedded into a molding material; in the pressing step, a force is continuously applied to the tread surface so that the 3D molding protrusion presses the molding material to form a model.

Preferably, a pigment storage cavity is arranged inside the toy sole body, and the pressing step further comprises a coloring process in which the pigment storage cavity adds pigment to the model.

Preferably, the toy sole body is provided with a pressure sensor and a sounding unit; the pressure sensor is used for detecting the value of the molding pressure, and when the value of the molding pressure is greater than a set threshold, the sounding unit emits a warning sound.

The beneficial effects of the present disclosure are as follows:

According to the present disclosure, when a user walks or plays in snow, he/she can step out 3D models of various shapes through simple foot movements, thus increasing fun and interaction of snow activities.

According to the present disclosure, a blocking protrusion is provided to conveniently connect a binding tape, and the binding tape can be then tied on a consumer's ankle and shoe upper. The toy is easy to wear when playing with snow and easy to take off when not playing with snow.

According to the present disclosure, a pigment storage cavity is provided to conveniently color the 3D model, so that the formed 3D model is more vivid and interesting.

According to the present disclosure, when consumers wearing the product and walking, the cooperation of the ground-touching surface and friction grooves plays a better anti-skid role, thus avoiding the slipping danger of consumers.

DETAILED DESCRIPTION OF THE PREFERRED EMBODIMENTS

Figure 1:
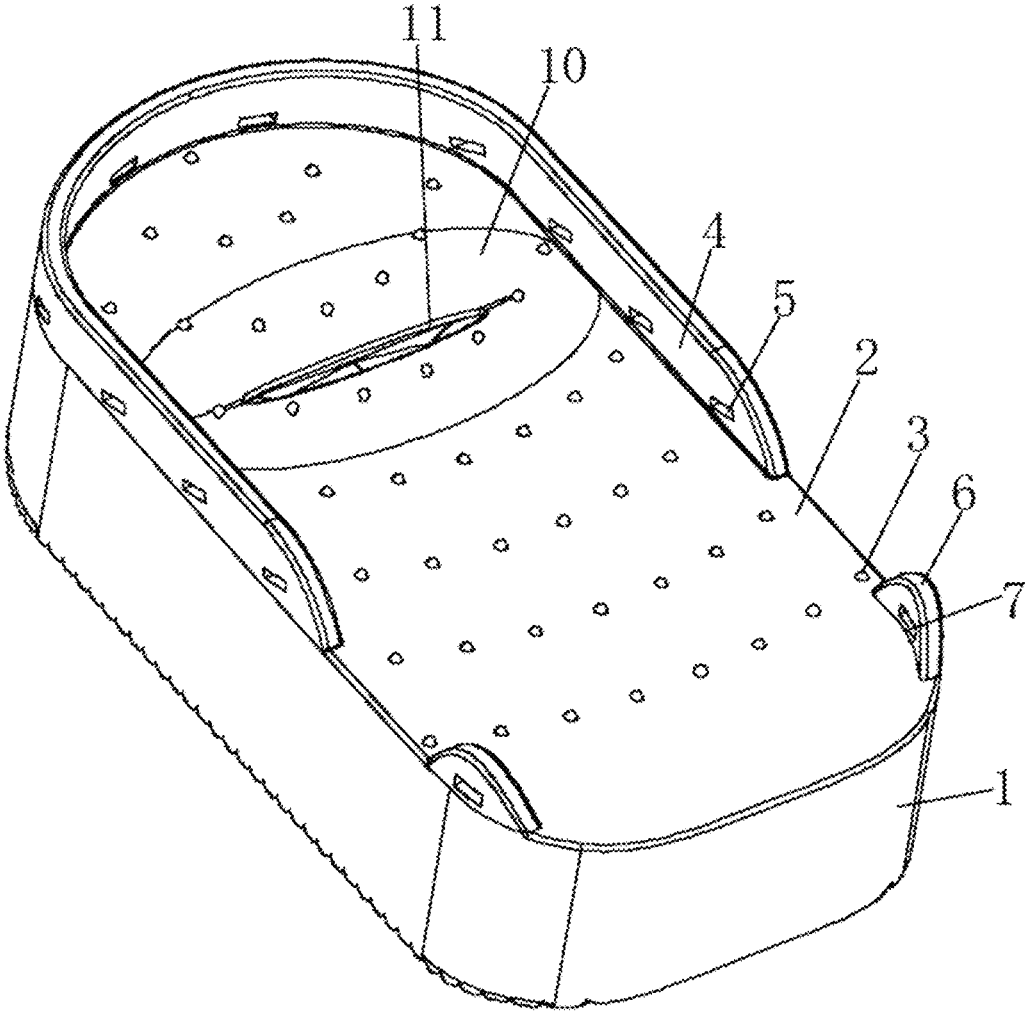
FIG. 1 is a schematic diagram of the 3D structure according to the present disclosure.
Figure 2:
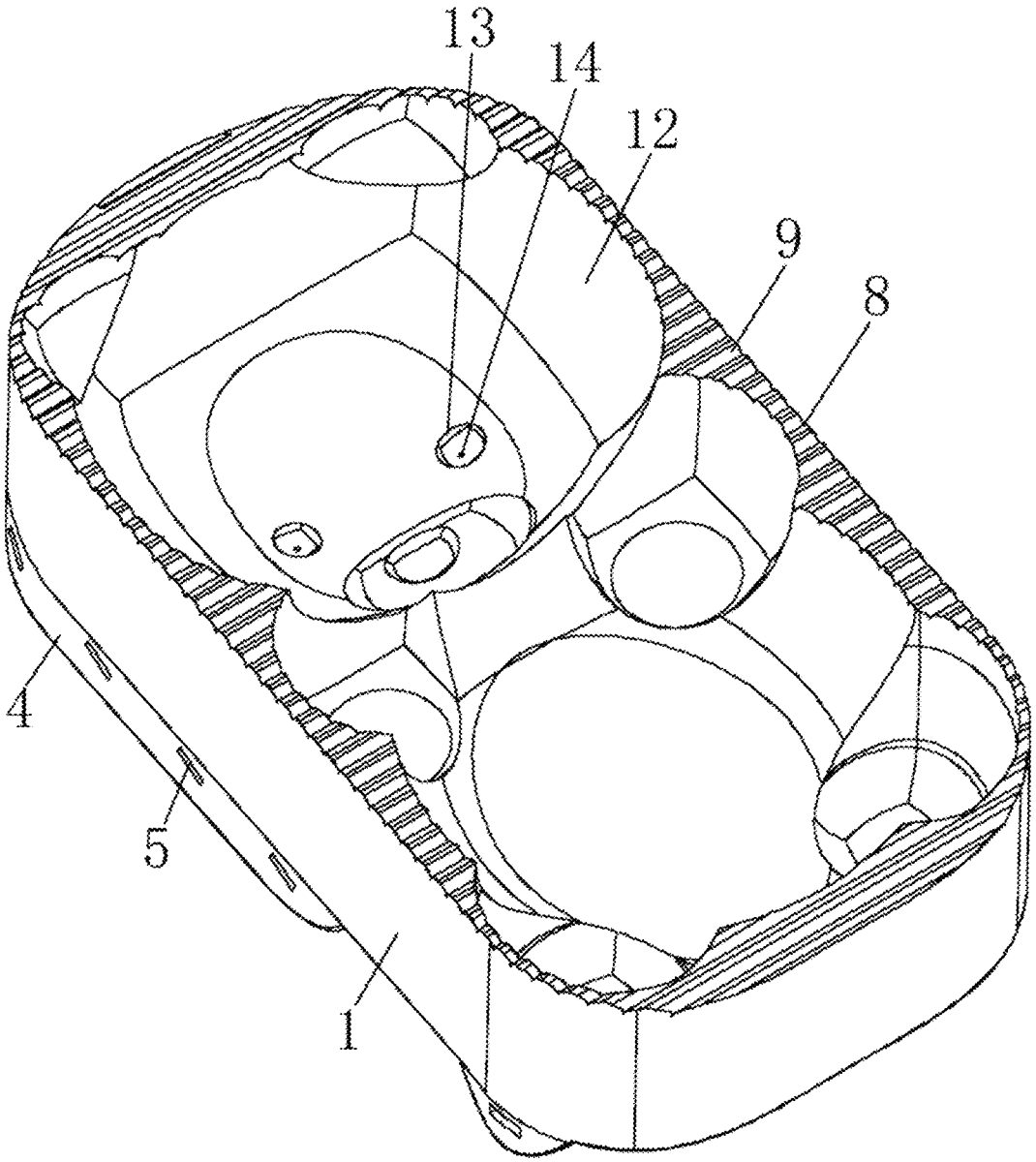
FIG. 2 is a schematic diagram of the bottom surface structure according to the present disclosure.
Figure 3:
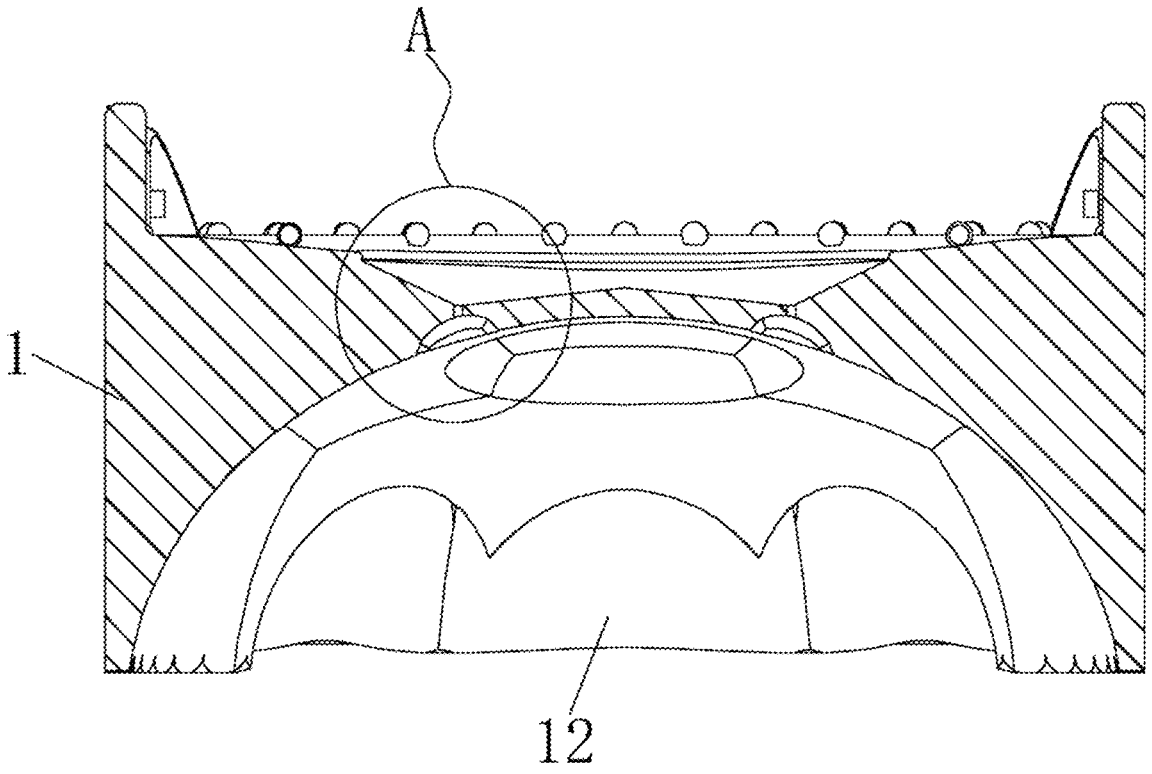
FIG. 3 is a schematic diagram of the sectional structure according to the present disclosure.

The present disclosure will be described in detail below with reference to the drawings by embodiments. The various examples are provided by way of explanation of the present disclosure and do not limit the present disclosure. Indeed, it will be clear to those skilled in the art that modifications and variations may be made in the present disclosure without departing from the scope or spirit of the present disclosure. For instance, features shown or described as part of one embodiment may be used in another embodiment to create yet another embodiment. Accordingly, it is desirable that the present disclosure encompasses such modifications and variations falling within the scope of the appended claims and their equivalents.

In the description of the present disclosure, the azimuthal or positional relationships indicated by terms such as "longitudinal", "transverse", "upper", "lower", "front", "rear", "left", "right", "vertical", "horizontal", "top" and "bottom" are based on those shown in the drawings, which are only for facilitating the description of the present disclosure rather than requiring that the present disclosure must be constructed and operated at a specific orientation, so they cannot be understood as limitations to the present disclosure. The terms "be connected with", "be connected to" and "arrange" used in the present disclosure are to be understood broadly, for instance, they may be fixed or detachable connections; they can be connected directly or indirectly through intermediate components; it may be a wired electrical connection, a radio connection or a wireless communication signal connection. Those of ordinary skill in the art can understand the specific meanings of the above terms according to the specific situation.

One or more examples of the present disclosure are shown in the accompanying drawings. Numeric and alphabetic notations are used in the detailed description to refer to features in the drawings. Similar or analogous references in the drawings and description have been used to refer to similar or analogous parts of the present disclosure. As used herein, the terms "first", "second" and "third" are used interchangeably to distinguish one component from another and are not intended to indicate location or importance of individual components.

Embodiment I

As shown in FIGS. 1-4, the present application provides a model-making toy capable of stepping out 3D models, comprising a toy sole body 1. The toy sole body 1 may be integrally formed by PVC material, which is easy to process and convenient to form, has strong deformability, can improve the comfort of consumers stepping on it on the upper surface, and can enhance the applicability to various road surfaces on the bottom surface.

The specific material of the sole body 1 is not limited, and may be rubber, silica gel, polyurethane (PU), ethylene vinyl acetate (EVA), thermo-plastic-rubber (TPR), thermoplastic polyurethane (TPU), polyvinyl chloride (PVC), artificial leather, natural leather, acrylic, etc.

The upper surface of the toy sole body 1 is provided with a tread surface 2, the tread surface 2 is for being stepped on by soles of the shoes worn by a consumer. In an embodiment in which the shoe sole is made of polymer material such as PVC, it is easy to clean when the product is not used.

The interior of the toy sole body is provided with a pigment storage cavity 15, and the 3D molding groove is provided with a connecting through hole that communicates with the pigment storage cavity 15. In the process of forming a 3D model, the pigment storage cavity 15 can add a pigment to the 3D model to improve fun.

The tread surface 2 is provided with a flow guiding slope 10. The flow guiding slope 10 is an inclined plane, which facilitates to guide the flow of pigment and makes it easier to flow to the central part. A liquid inlet 11 is arranged inside the tread surface 2, and the liquid inlet 11 is located in the center of the flow guiding slope 10. The liquid inlet 11 can guide the pigment downward into the pigment storage cavity 15 below the liquid inlet 11. The pigment storage cavity 15 is funnel-shaped for temporary storage of pigment. The pigment can be environment-friendly color ink, which is a kind of color ink that uses environmental-friendly raw materials in the production process and meets environmental protection standards. It does not contain harmful substances, such as heavy metals, volatile organic compounds (VOCs), etc., and is harmless to the environment and human health.

The bottom surface of the toy sole body 1 is provided with a ground-touching surface 8, and the ground-touching surface 8 has a plurality of friction grooves 9, and the friction grooves 9 are arranged at intervals on the bottom surface of the ground-touching surface 8. The friction grooves 9 can be arranged at intervals on the ground-touching surface 8, which can play a better anti-skid role and prevent consumers from slipping on snowy days.

The tread surface 2 is integrally formed with a plurality of friction beans 3, and the friction beans 3 are arranged at intervals on an upper surface of the tread surface 2. Specifically, the friction beans 3 can be arranged on the upper surface of the tread surface 2 in a horizontally and vertically equidistant manner to increase the friction between a consumer's own sole and the tread surface 2, so as to prevent the product from slipping off when the consumer moves while wearing the product.

The toy sole body is provided with a connection structure for assembling the model-making toy to a shoe bottom. The connecting structure includes a blocking protrusion provided on the tread surface for abutting against a user's shoe. The blocking protrusion is provided with tape threading holes through which the model-making toy can be attached to the shoe bottom by threading a binding tape.

Specifically, the blocking protrusion may include a first protrusion 4 and two second protrusions 6. The first protrusion 4 is located at one end of the toy sole body. The two second protrusions 6 are located at the other end of the toy sole body. The first protrusion 4 is provided with a first tape threading hole 5. The second protrusion 6 is provided with a second tape threading hole 7. The fixing effect of the model-making toy can be improved by providing a plurality of protrusions and tape threading holes.

In particular, the first protrusion 4 may be integrally formed with the toy sole body. The first protrusion 4 is provided with a plurality of first tape threading holes 5. After threading a binding tape through the first tape threading holes 5, the binding tape can be tied to the ankle of a consumer, so that the rear part of the toy sole body is connected and fixed with the heel.

The two second protrusions 6 may be integrally formed with the toy sole body. The two second protrusions 6 are provided with second tape threading hole 7, and the binding tape can be tied to the shoe upper worn by a consumer through the two second tape threading holes 7, so that the front part of the toy sole body is connected and fixed with the front part of the sole, thus finally realizing comprehensive fixing of the product.

The ground-touching surface 8 is provided with a 3D molding groove, the 3D molding groove can be a bear-shaped 3D molding groove 12. After wearing this product, consumers can step on snow to form a snowman-shaped 3D model identical to the bear-shaped 3D molding groove 12.

The connecting through holes may include two bear-eye-shaped connecting through holes 14. The bear-eye-shaped connecting through holes 14 are located at the eye position of the bear-shaped 3D molding groove 12. During the molding process, the pigment in the pigment storage cavity 15 is applied to the eyes of the bear to improve fun.

Figure 5:
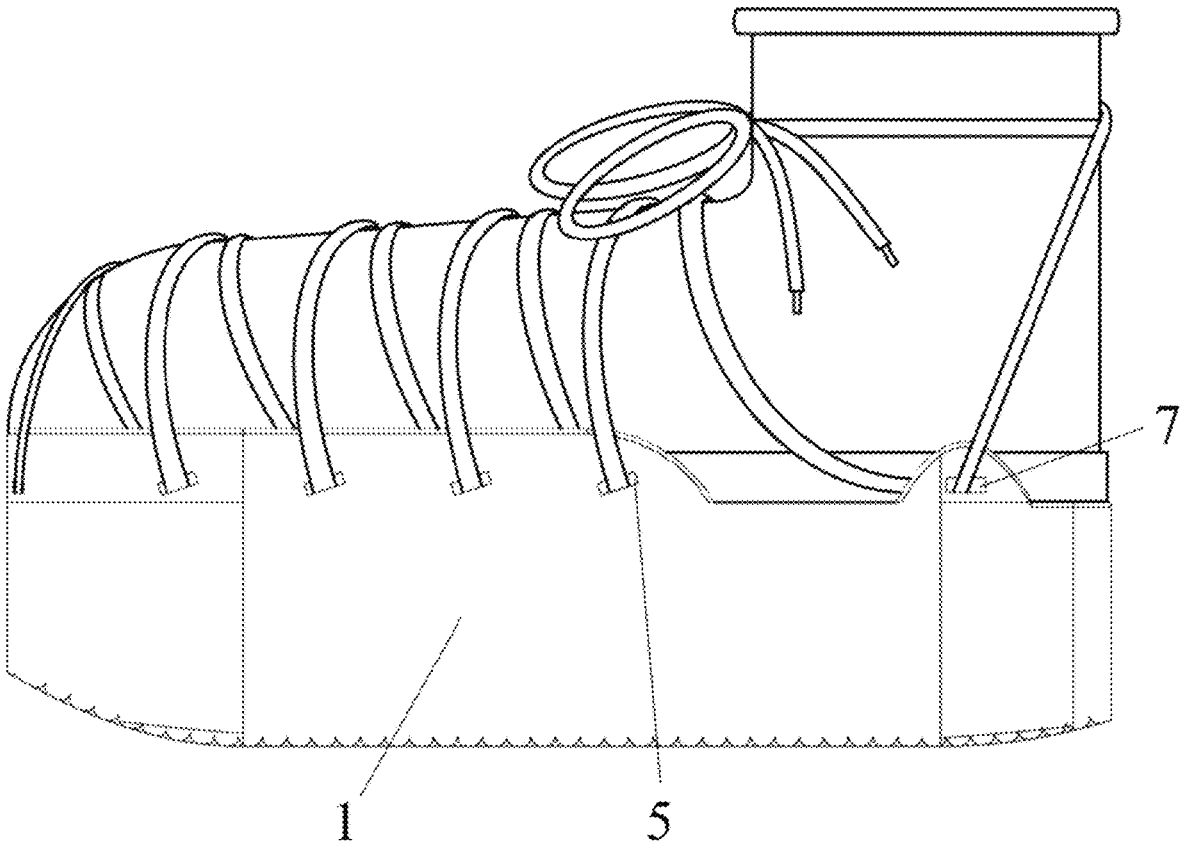
FIG. 5 is a structural diagram of the toy of the present disclosure mounted on the sole.

Further referring to FIG. 5, the working principle of this embodiment is as follows:

When a consumer goes out to play with snow on a snowy day, at the very beginning, pour the prepared pigment onto a flow guiding slope 10, and the pigment flows into the inside of a pigment storage cavity 15 through a liquid inlet 11 after being guided by the flow guiding slope 10. Then, thread a binding tape through each first tape threading hole 5 in turn, then tie the binding tape to the ankle, and thread another binding tape through two second tape threading holes 7 and tie it to the shoes of a consumer, so that the consumer can go to play with snow on the snowfield. The snow on the ground can be stepped into the shape of the bear-shaped 3D molding groove 12. The pigment inside the pigment storage cavity 15 can fall on the animal's eyes made of the 3D molding groove 13 through the eye connecting hole 14, which plays a finishing role and brings unprecedented interactive experience and creative fun to users.

Embodiment II

Figure 6:
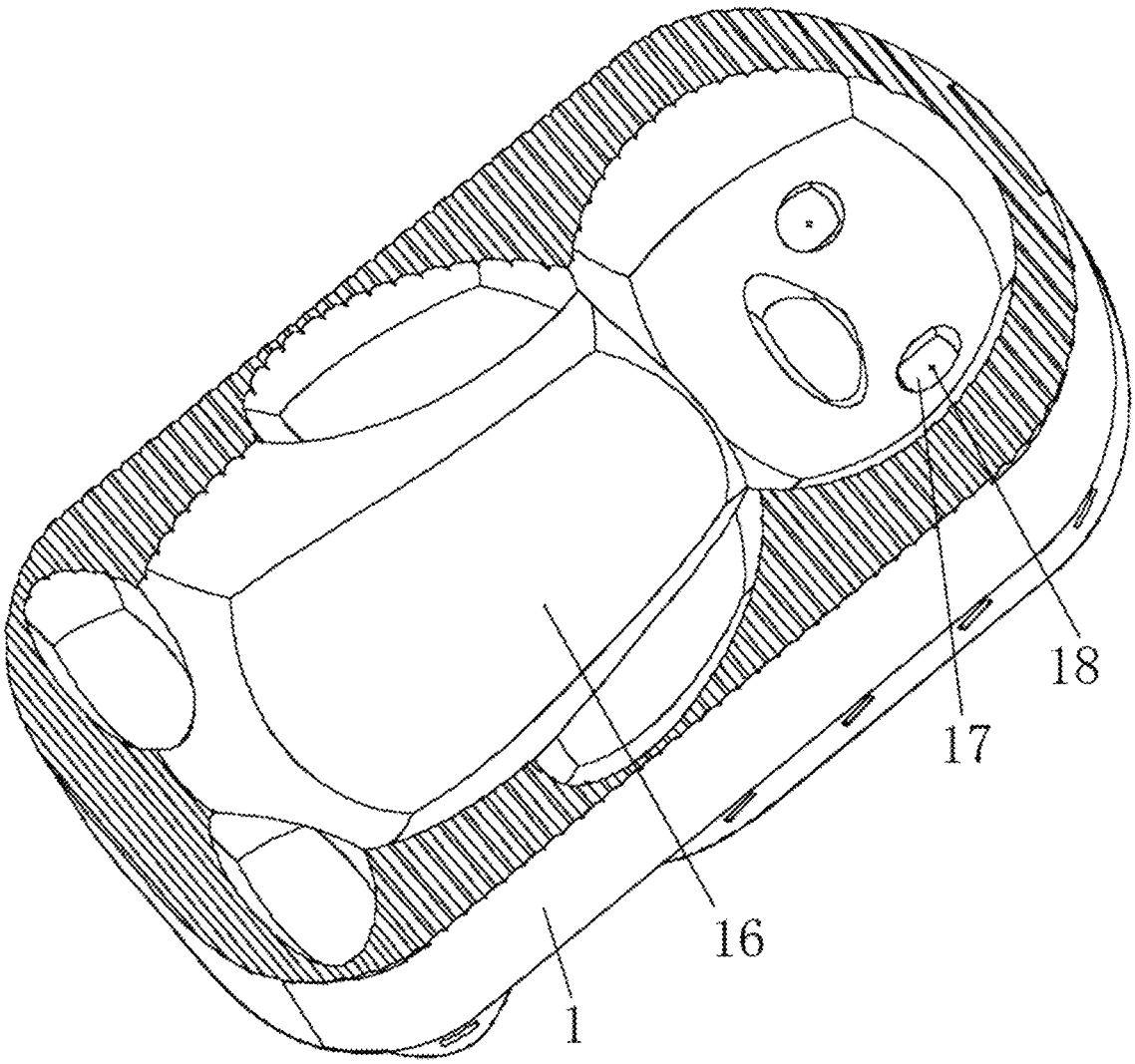
FIG. 6 is a schematic diagram of a 3D penguin structure according to the present disclosure.

As shown in FIG. 6, the difference between this embodiment and Embodiment I is that a model of penguin-shaped 3D molding groove 16 can be formed on the ground, which is different from the bear-shaped 3D molding groove 12. The connecting through holes may comprise two penguin-eye-shaped connecting through holes 18. The penguin-eye-shaped connecting through hole 18 is provided in the penguin-shaped 3D molding groove 17. During the molding process, the pigment in the pigment storage cavity 15 is applied to the eyes of the penguin to improve fun.

Embodiment III

Figure 7:
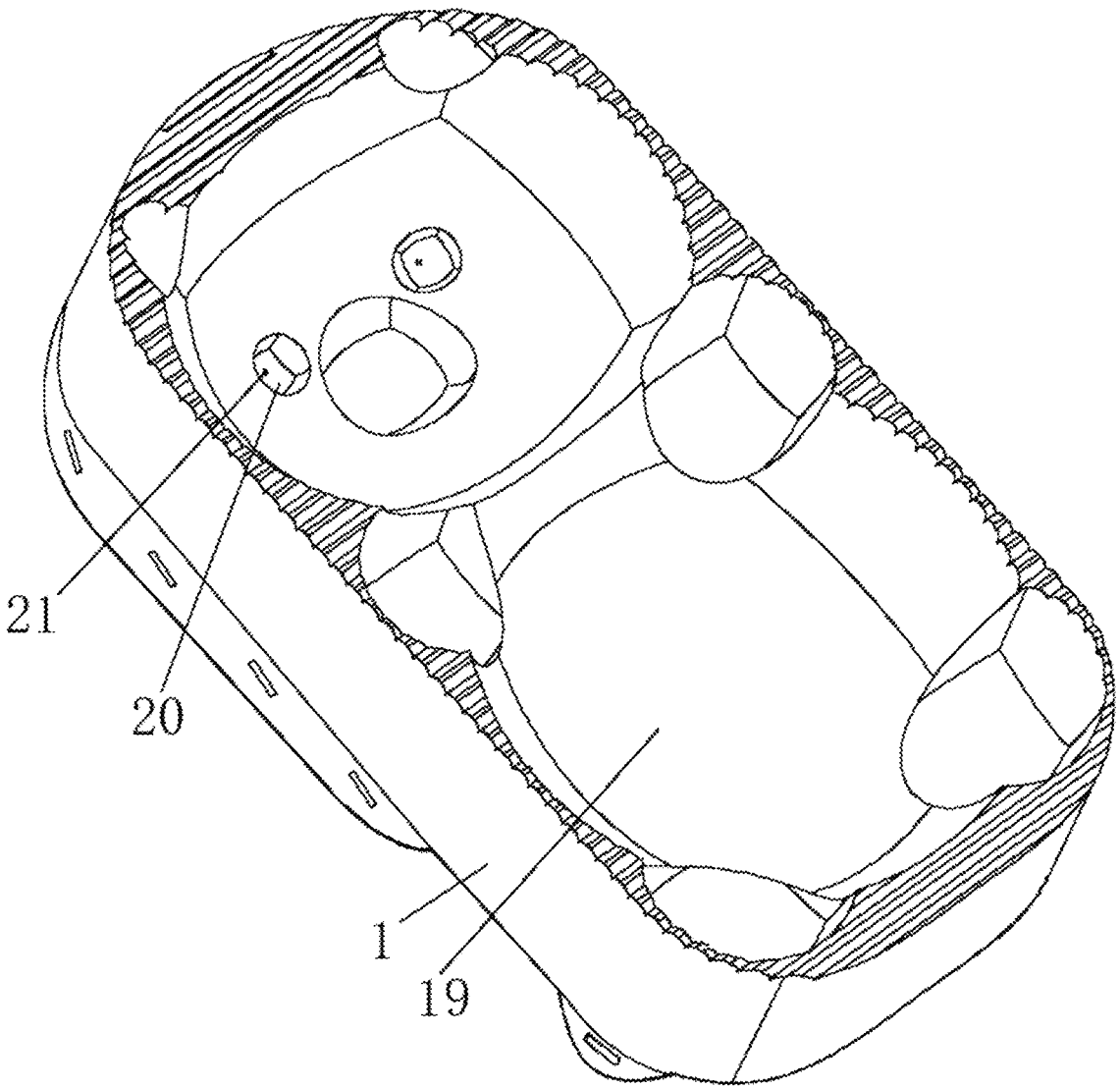
FIG. 7 is a schematic diagram of a 3D piglet structure according to the present disclosure.
Figure 8:
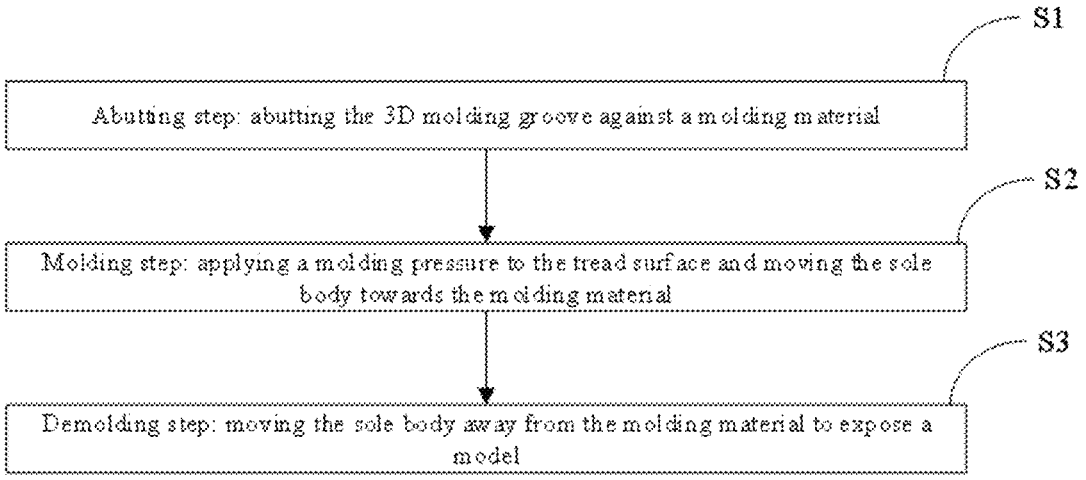
FIG. 8 is a flow chart of a method for extruding a 3D model according to an exemplary embodiment of the present disclosure.

As shown in FIG. 7, the difference between this embodiment and Embodiment I is that a model of piglet-shaped 3D molding groove 16 can be formed on the ground, which is different from the bear-shaped 3D molding groove 12. The connecting through holes may comprise two piglet-eye-shaped connecting through holes 21. The piglet-eye-shaped connecting through hole 21 is provided in the piglet-shaped 3D molding groove 20.

In addition to the bear model, penguin model and piglet model, the 3D molding groove can further be used for molding humanoid models such as Santa Claus. The specific type of the 3D molding groove is not limited, and the type of model can be selected according to actual needs.

As shown in FIG. 1-FIG. 4 and FIG. 8, the present application further provides a method for stepping out 3D models, which is applied to the soles capable of pressing out 3D models according to Embodiments I to III. The method comprises the following steps:

S1, abutting step: abutting the 3D molding groove against the molding material.

S2, molding step: applying a molding pressure to the tread surface 2 to move the sole body 1 toward the molding material, so that the molding material forms a model in the 3D molding groove.

S3, demolding step: moving the sole body 1 away from the molding material to expose a model.

The molding material of the present application may be a powdered plastic material. In the process of playing on a snowy day, the molding material of a 3D model is snow. In other applications, the molding material may be sand. In the abutting step S1, a consumer selects an area where a model is to be formed and abuts the sole against the selected area. In the molding step S2, the consumer presses down the sole with force so that snow can be accommodated in the 3D molding groove to form a model on the snow. In the demolding step S3, the consumer removes the sole to view the molded model and experience the fun of interacting with the snow. Through this method, the molding of animal models such as a bear model, a piglet model and a penguin model can be realized, and the forming of humanoid models such as Santa Claus can also be realized. The specific types are not limited.

Figure 9:
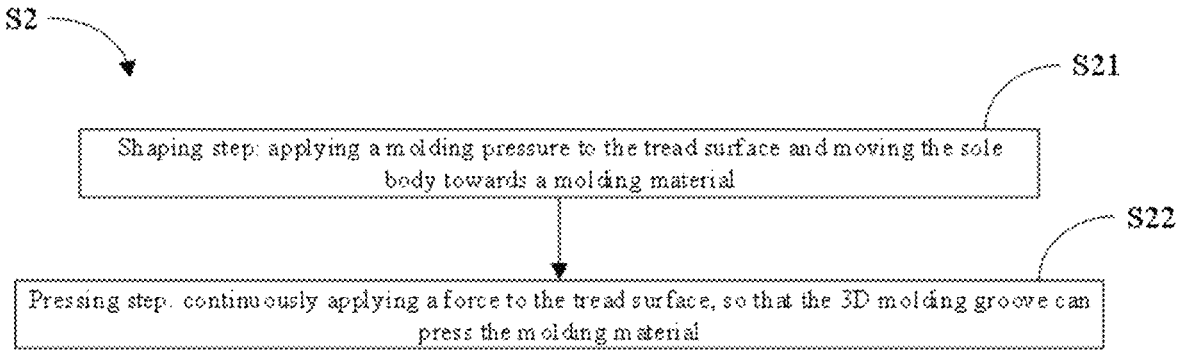
FIG. 9 is a flow chart of the molding step in FIG. 8 according to an embodiment.

Further referring to FIG. 9, the molding step S2 may include a shaping step S21 and a pressing step S22. In the shaping step, a force is applied to the tread surface 2, and the sole body 1 moves toward a molding material so that the molding material fills into the 3D molding groove. In the pressing step, a force is continuously applied to the tread surface 2, so that a 3D molding groove can press the molding material to form a model. By dividing the molding step S2 into a shaping step S21 and a pressing step S22, it is possible to improve the stability of a model, maintain its shape, and prevent the model from collapsing. In other embodiments, the specific process of the molding step is not limited.

Figure 10:
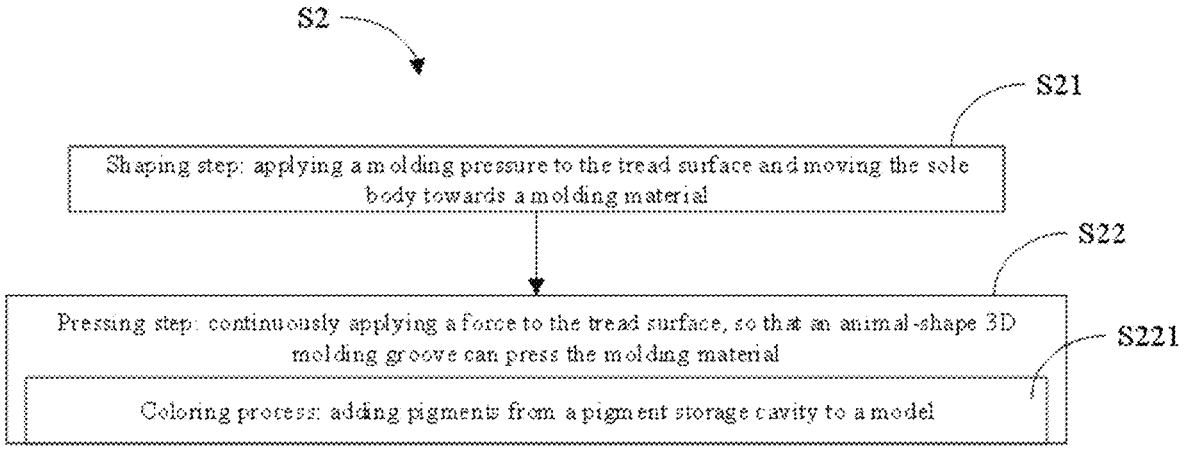
FIG. 10 is a flow chart of the molding step of FIG. 8 according to an alternative embodiment.
Figure 11:
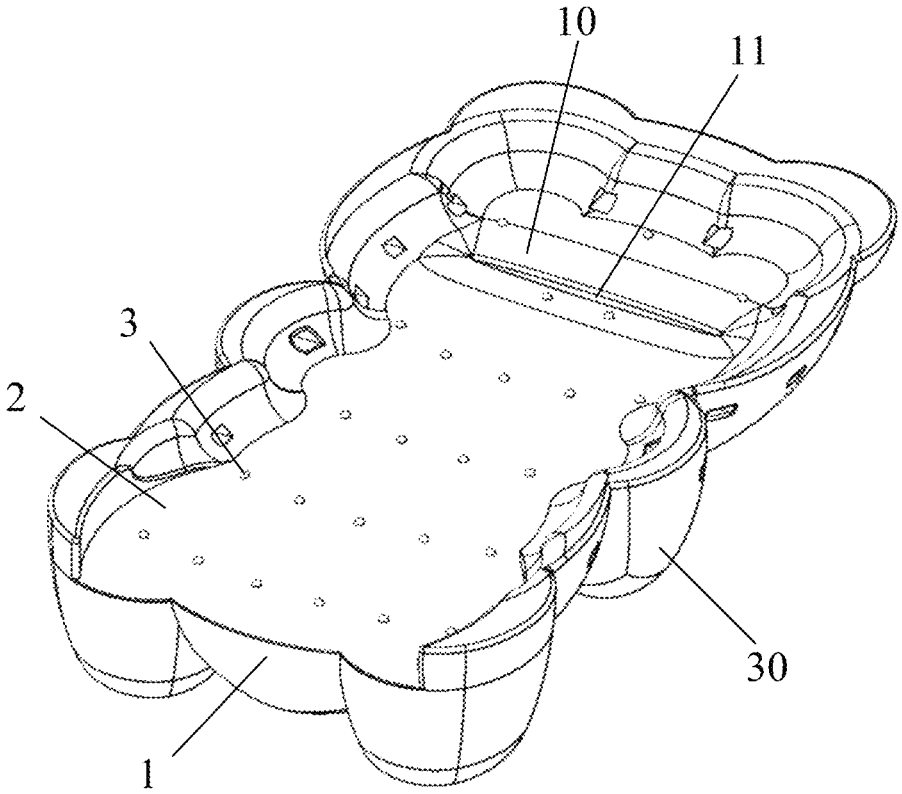
FIG. 11 is a structural diagram of a sole according to an exemplary embodiment of the present disclosure.

Further referring to FIG. 10, the pressing step S22 may include a coloring process S221. In the eye-shaping process S221, the pigment storage cavity 15 adds a pigment to an eye position of the model. By adding pigment to the eyes of the model, it makes the model more vivid and further improves its interest. In other embodiments, the specific process of the pressing step is not limited.

As shown in FIG. 11 to FIG. 14, in some embodiments, the 3D molding groove can be replaced with a 3D molding protrusion 30 to expand the function of the sole and improve the level of interest. The sole body is provided with a 3D molding protrusion 30 on a side opposite to the tread surface. In these embodiments, the tread surface may be provided with a blocking protrusion for limiting the shoes. The blocking protrusion is provided with tape threading holes for threading the binding tape to attach the model-making toy to a user's shoe.

There is no specific type of the 3D molding protrusion 30, for instance, it can be an animal shaped protrusion such as a bear-shaped 3D molding protrusion 31, a penguin-shaped 3D molding protrusion 32 and a piglet-shaped 3D molding protrusion 33, or a figure-shaped protrusion such as Santa Claus. Specific descriptions are as follows:

Embodiment IV

Figure 4:
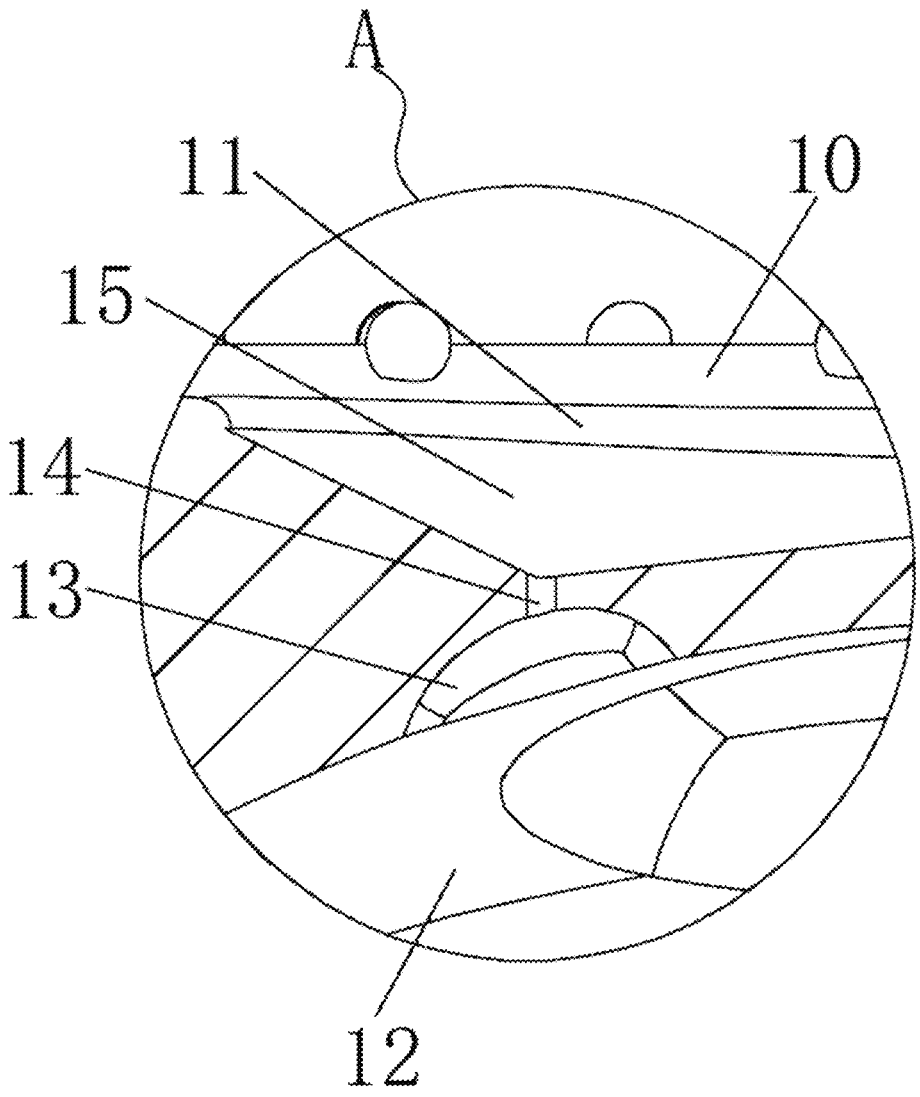
FIG. 4 is an enlarged view of Position A in FIG. 3 according to the present disclosure.
Figure 12:
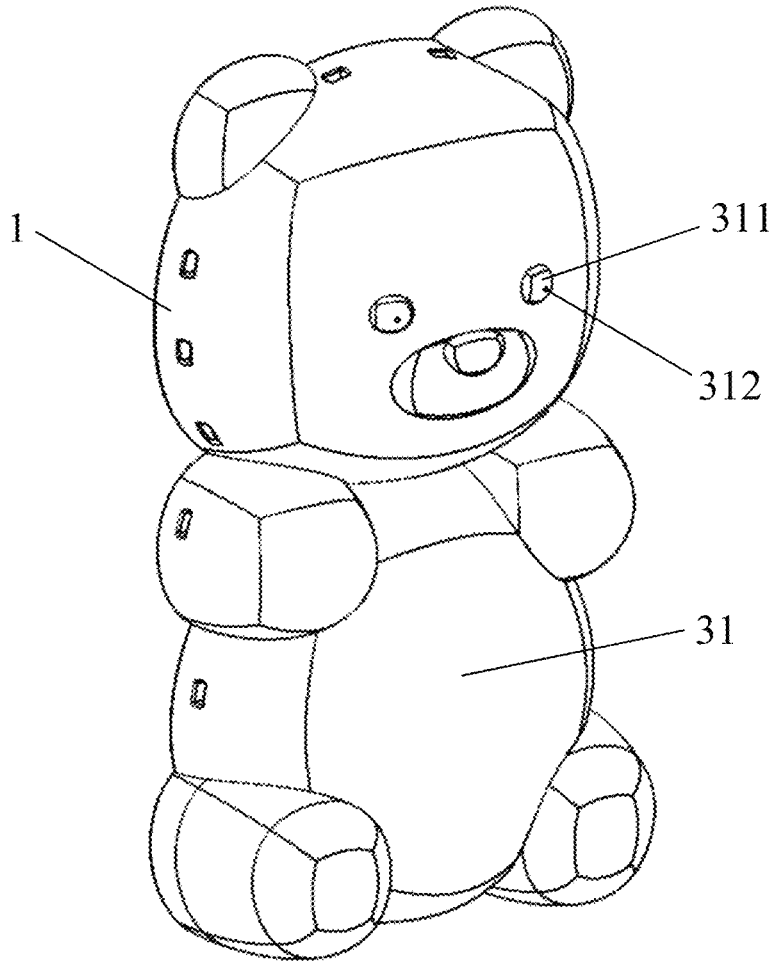
FIG. 12 is a perspective view of a sole provided with a bear-shaped 3D molding protrusion according to an exemplary embodiment of the present disclosure.

As shown in FIGS. 4 and 12, the 3D molding protrusion 30 is a bear-shaped 3D molding protrusion 31. Two bear-eye-shaped 3D molding protrusions 311 are arranged on the outer surface of the bear-shaped 3D molding protrusion 31. Each of the two bear-eye-shaped 3D molding protrusions 311 is provided with a first communicating hole 312, and the first communicating hole 312 is opened in the sole body 1 and communicated with the pigment storage cavity 15, so that the bear model obtained by 3D molding is more vivid.

Embodiment V

Figure 13:
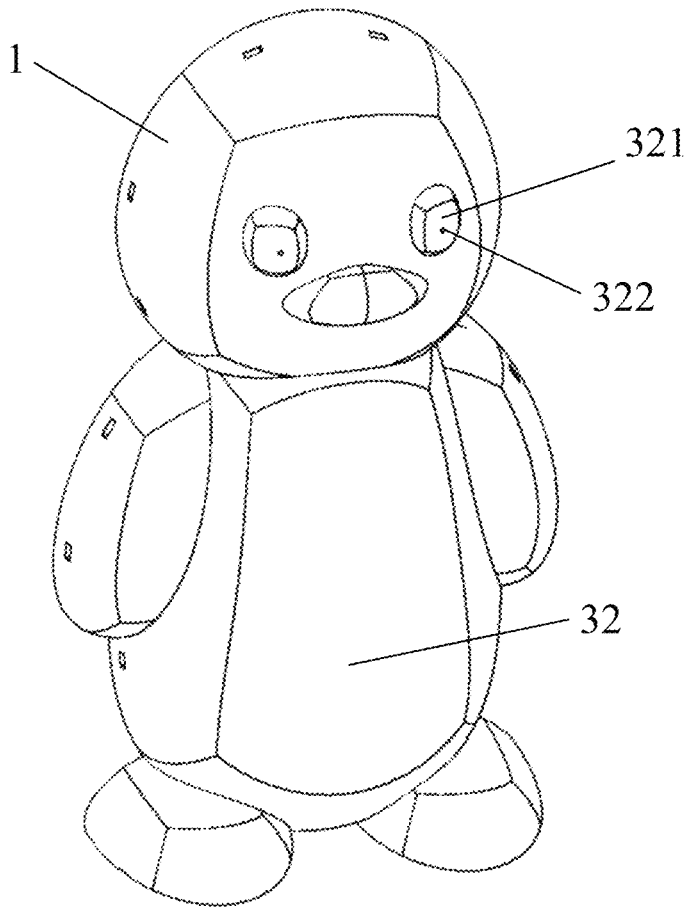
FIG. 13 is a perspective view of a sole provided with a penguin-shaped 3D molding protrusion according to an exemplary embodiment of the present disclosure.

As shown in FIGS. 4 and 13, the 3D molding protrusion 30 is a penguin-shaped 3D molding protrusion 32. Two penguin-eye-shaped 3D molding protrusions 321 are arranged on the outer surface of the penguin-shaped 3D molding protrusion 32. Each of the two penguin-eye-shaped 3D molding protrusions 321 is provided with a second communicating hole 322, and the second communicating hole 322 is opened in the sole body 1 and communicated with the pigment storage cavity 15, so that the penguin model obtained by 3D molding is more vivid.

Embodiment VI

Figure 14:
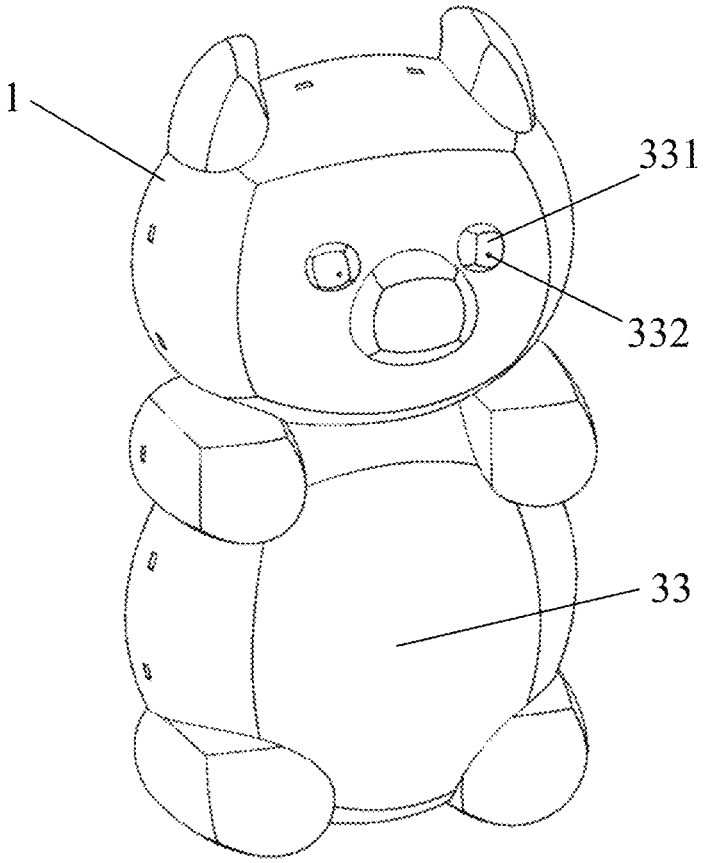
FIG. 14 is a perspective view of a sole provided with a piglet-shaped 3D molding protrusion according to an exemplary embodiment of the present disclosure.

As shown in FIGS. 4 and 14, the 3D molding protrusion 30 is a piglet-shaped 3D molding protrusion 33. Two piglet-eye-shaped 3D molding protrusions 331 are arranged on the outer surface of the piglet-shaped 3D molding protrusion 33. Each of the two piglet-eye-shaped 3D molding protrusions 331 is provided with a third communicating hole 332, and the third communicating hole 332 is opened in the sole body 1 and communicated with the pigment storage cavity 15, so that the piglet model obtained by 3D molding is more vivid.

Figure 15:
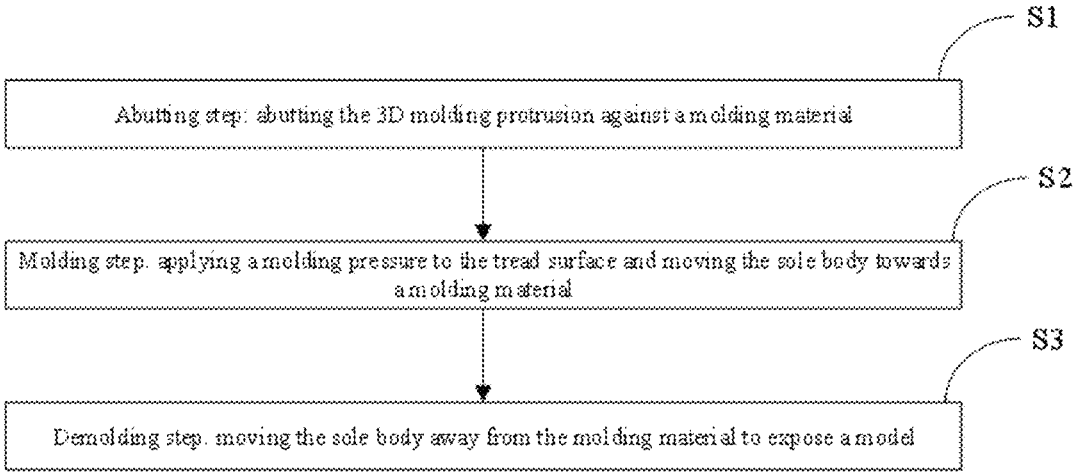
FIG. 15 is a flow chart of another method for extruding a 3D model according to an exemplary embodiment of the present disclosure.

As shown in FIG. 4 and FIG. 15, the present application further provides a method for stepping out 3D models, which is applied to the soles capable of pressing out 3D models according to Embodiments IV to VI. The method comprises the following steps:

S1, abutting step: abutting the 3D molding protrusion 30 against the molding material;

S2, molding step: applying a molding pressure to the tread surface 2 to move the sole body 1 toward the molding material, so that the 3D molding protrusion 30 forms a model in the molding material;

S3, demolding step: moving the sole body 1 away from the molding material to expose a model.

The molding material may be a powdered plastic material. In the process of playing on a snowy day, the molding material can be snow. In other applications, the molding material may be sand. In the abutting step S1, a consumer selects an area where a model is to be formed and abuts the sole against the selected area. In the molding step S2, a consumer presses down the sole with force so that the 3D protrusion is inserted into the interior of the snow to expose a model in the snow. In the demolding step S3, the consumer removes the sole to view the molded model and experience the fun of interacting with the snow. Through this method, the molding of animal models such as a bear model, a piglet model and a penguin model can be realized, and the forming of humanoid models such as Santa Claus can also be realized. The specific types are not limited.

Figure 16:
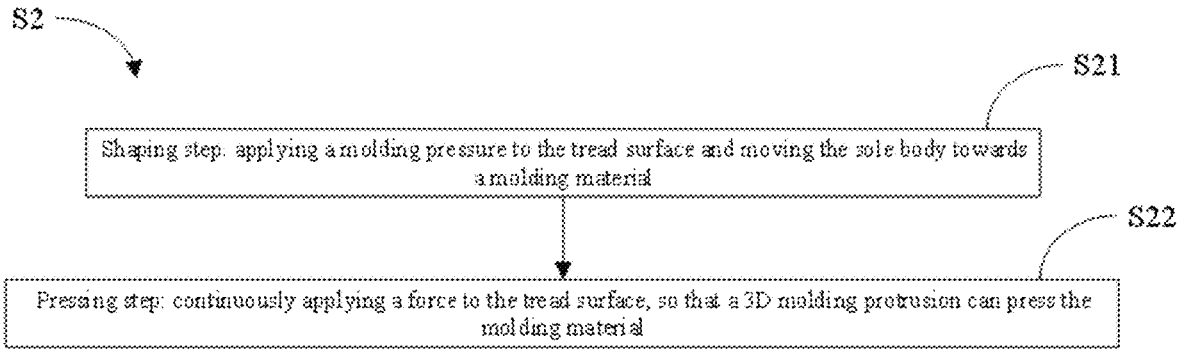
FIG. 16 is a flow chart of the molding step in FIG. 15 according to an embodiment.

Further referring to FIG. 16, the molding step S2 may include a shaping step S21 and a pressing step S22. In the shaping step, the sole body 1 moves toward a molding material so that a 3D molding protrusion 30 is embedded into the molding material. In the pressing step, a force is continuously applied to the tread surface 2, so that a 3D molding protrusion 30 can press the molding material to form a model. By dividing the molding step S2 into a shaping step S21 and a pressing step S22, it is possible to improve the stability of a model, maintain its shape, and prevent the model from collapsing. In other embodiments, the specific process of the molding step is not limited.

Figure 17:
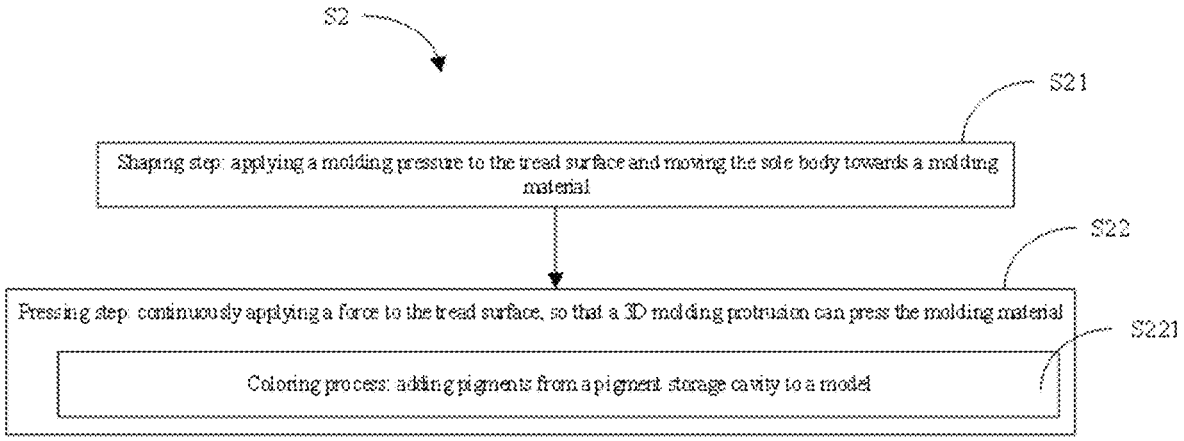
FIG. 17 is a flow chart of the molding step of FIG. 15 according to an alternative embodiment.

Further referring to FIG. 17, the pressing step S22 may include a coloring process S221. In the coloring process S221, the pigment storage cavity 15 adds a pigment to an eye position of the model. By adding pigment to the eyes of the model, it makes the model more vivid and further improves its interest. In other embodiments, the specific process of the pressing step is not limited.

Figure 18:
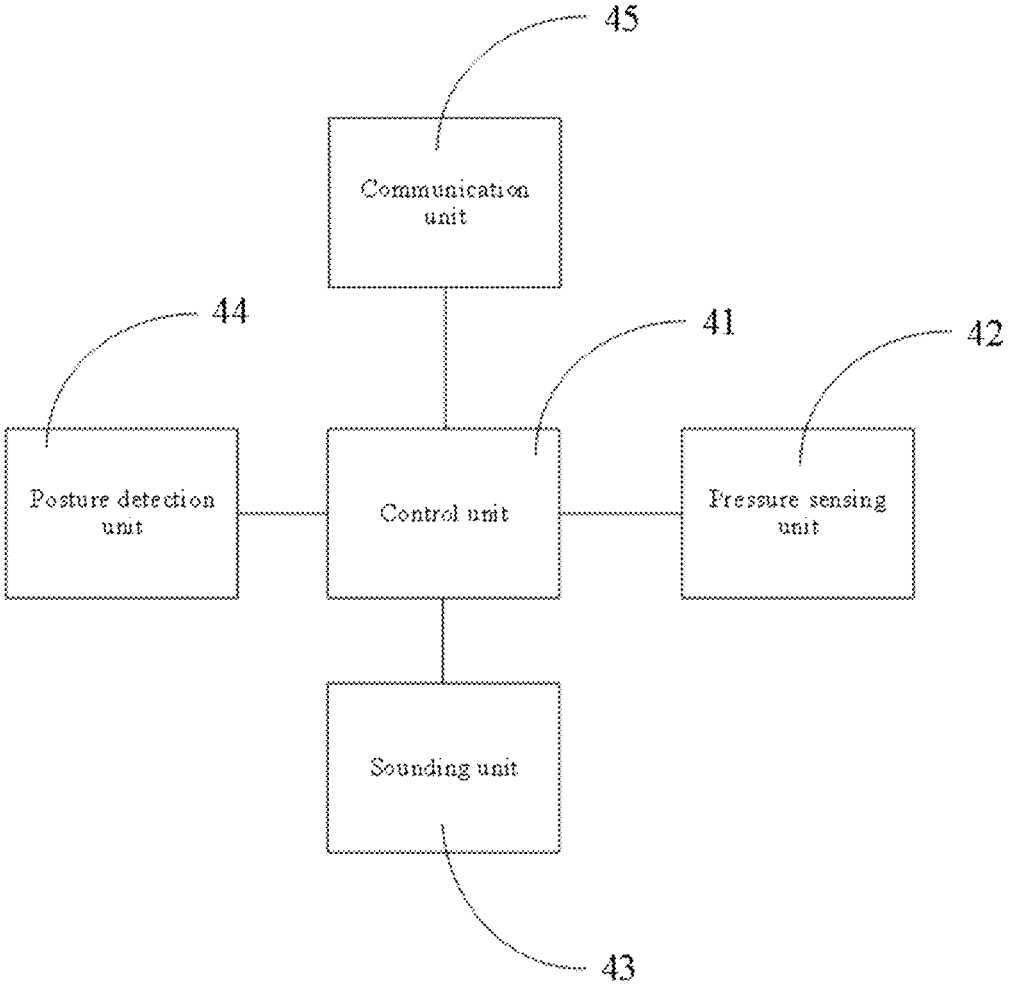
FIG. 18 is a schematic diagram illustrating connection of hardware modules in the sole body according to the present disclosure.

In some embodiments, as shown in FIG. 18, the sole body 1 may be provided with a processing unit 41, a pressure sensing unit 42 and a sounding unit 43. The pressure sensing unit 42 may set a corresponding pressure threshold, and when it is detected that the pressure value reaches the set pressure threshold, the processing unit 41 controls the sounding unit 43 to make a corresponding sound so as to remind the user that the 3D model has been formed, and the user can remove the model-making toy. In this process, the sounding unit 43 may emit a sound that matches the model type. For example, the sound may be cries of the above-mentioned piglet, penguin and bear, or the sound effect of Santa Claus.

In order to improve the user experience and ensure that the sounding unit 43 only produces sound when a model molding is completed, dynamic threshold setting may be performed on the pressure sensing unit 42. When the sole is used, a corresponding pressure will also be generated by the user's daily walking. The processing unit 41 may collect these pressures daily and use them as a pressure threshold. When molding a model, the user may consciously increase the force of stepping on it. At this time, the pressure value will be greater than the pressure when the user walks, and the processing unit 41 determines that the state is 3D molding of the model, and the sounding unit 43 emits a corresponding sound.

When the user is running, the pressure value measured by the pressure sensing unit 42 may also be larger, causing the sounding unit 43 to make a sound at will. Therefore, a posture detection unit 44 such as a gyroscope can be disposed in the sole to comprehensively determine whether the user is in the 3D molding state based on the data detected by the pressure sensing unit 42, thereby improving the determination accuracy of the use state.

When molding a model, the user will consciously make a certain pause so that the posture of the sole is relatively stable. At this time, the data measured by the posture detection unit 44 changes little. When the processing unit 41 detects that the data change of the posture detection unit 44 is small and receives larger pressure data from the pressure sensing unit 42 at the same time, it determines that the user performs 3D molding of the model and controls the sounding unit 43 to emit a sound.

Figure 19:
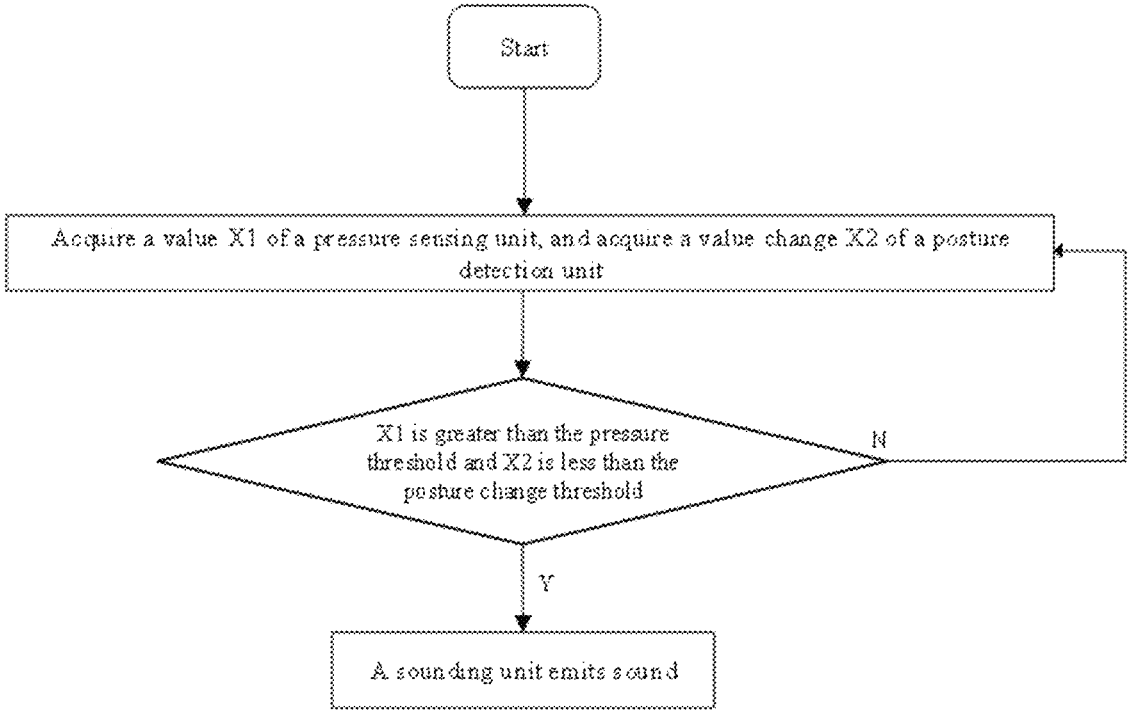
FIG. 19 is a flow chart of activating a sounding unit according to an exemplary embodiment of the present disclosure.

The specific process is further shown in FIG. 19. First, the processing unit 41 obtains a value X1 of the pressure sensing unit 42 and a value change X2 of the posture detection unit in a unit time (the unit time may be 1 second or the like), respectively. The larger the value of X1, the greater the pressure generated by the user is, and the greater the acting force exerted by the user. The smaller the value of X2, the smaller the change in sole posture is, and the user pauses for a certain time. Second, it is determined whether or not X1 is larger than a set pressure threshold and whether or not X2 is smaller than a set posture change threshold. When X1 is larger than the pressure threshold value and X2 is smaller than the posture change threshold value, the sounding unit 43 is activated to emit a sound.

In other embodiments, only the pressure sensing unit 42 or only the posture detection unit 44 may be used to realize the determination of the use state. For instance, when only X1 is greater than the pressure threshold or only X2 is less than the posture change threshold, the sounding unit is activated to emit a sound.

In some embodiments, as shown in FIG. 18, a communication unit 45 may be further disposed in the sole for connecting with a mobile terminal such as a cell phone. Since the sole body 1 is provided with the pressure sensing unit 42 and the posture detection unit 44, it can be determined whether a user falls down by monitoring data of the pressure sensing unit 42 and the posture detection unit 44, and an alarm can be sent to the mobile terminal through the communication unit 45. When a child falls down in the snow, parents can timely sense and take countermeasures.

When a user falls down, the value of the pressure sensing unit 42 may become smaller due to detachment from the ground. At the same time, under normal walking conditions, the sole is basically in a horizontal position or at a small angle with the horizontal direction. When a user falls down, the posture of the sole may change to an upright position or at a large angle with the horizontal direction. Therefore, the angle between the sole body 1 and the horizontal direction can be detected by the posture detection unit 44 to determine the user's falling behavior. By comprehensively detecting the values of the pressure sensing unit 42 and the posture detection unit 44, the accuracy detecting a user's falling down is improved.

Figure 20:
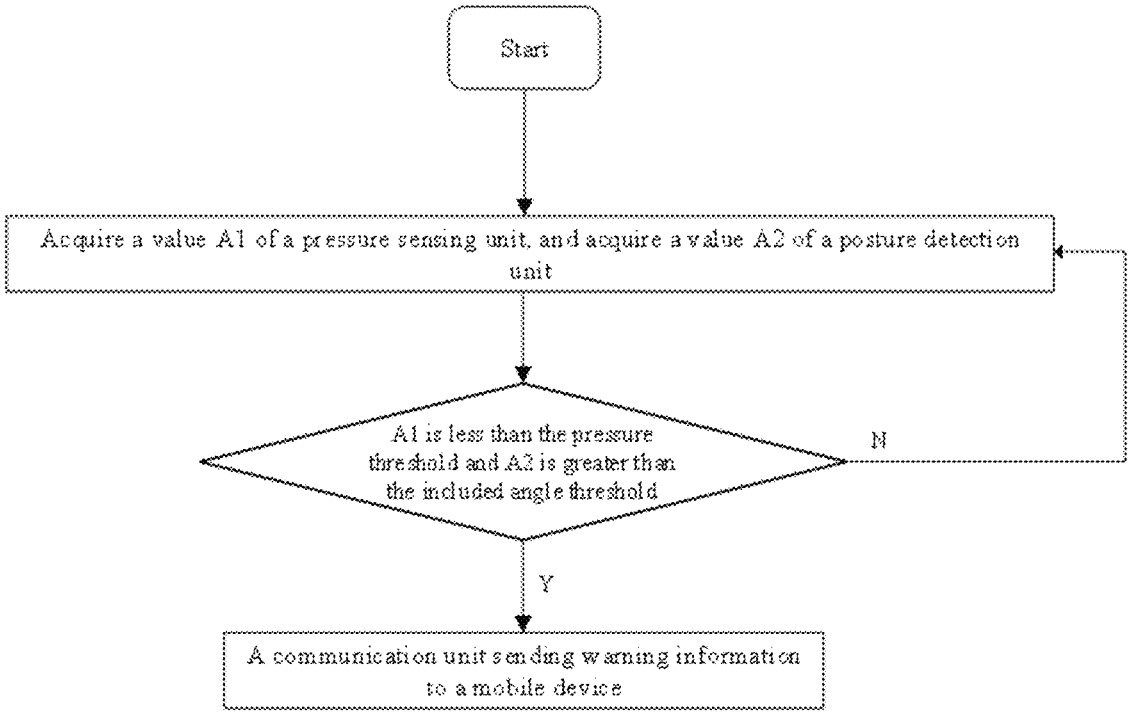
FIG. 20 is a flow chart of activating a communication unit according to an exemplary embodiment of the present disclosure.

The specific process is further shown in FIG. 20. First, the processing unit 41 obtains a value A1 of the pressure sensing unit 42 and a value A2 of the posture detection unit 44, respectively. The smaller the value of A1, the greater the pressure exerted by the user is, and the user detaches from the ground. The larger the value of A2, the greater the included angle between the sole and the horizontal direction is, and the user tips over. When it is detected that the value of A1 is less than the pressure threshold and the value of A2 is greater than the angle threshold, the processing unit 41 judges that the current user falls down, and activates the communication unit 45 to send a warning message to the mobile terminal.

In other embodiments, it is also possible to use only the pressure sensing unit 42 or only the posture detection unit 44 for detecting that a user falls. For instance, when only the value of A1 is less than the pressure threshold or only the value of A2 is greater than the angle threshold, the communication unit 45 is activated to send a warning message to the mobile device.

The sole of the present disclosure is provided with a 3D molding groove or a 3D molding protrusion, so that when users play in the snowfield, corresponding animal models can be formed on the snowfield, such as piglet, bear, penguin and Santa Claus, etc.. In addition, the model can be colored by setting a pigment storage cavity, which has a high interest.

By arranging the processing unit 41, the pressure sensing unit 42 and the sounding unit 43 in the sole body, it is possible to remind a user that the model has been formed during the forming process, so as to remind the user to remove the model-making toy or generate a sound matching with the type of the model, thus further improving fun.

At the same time, by providing the posture detection unit 44, the sole can detect the user's state more accurately. On the one hand, it can be detected whether a user is molding or walking as usual, so as to judge whether a corresponding sound needs to be made, thereby improving the user experience. On the other hand, it is possible to detect the fall of a user and send an alarm to the electronic device through the communication unit 45.

The above are only preferred embodiments of the present disclosure and shall not be used to limit the present disclosure. For those skilled in the art, various modifications and changes may be made to the present disclosure. Any modifications, equivalent substitutions, improvements, etc., made within the spirit and principles of the present disclosure shall be included within the protection scope of the present disclosure.

The invention claimed is:

1. A model-making toy capable of stepping out 3D models, comprising a toy sole body, wherein an upper surface of the toy sole body is provided with a tread surface, and a bottom surface of the toy sole body is provided with a ground-touching surface; the ground-touching surface is provided with a 3D molding groove; the toy sole body is provided with a connecting structure for assembling the model-making toy to a shoe bottom;

wherein a pigment storage cavity is arranged inside the toy sole body, the 3D molding groove is provided with a connecting through hole, and the connecting through hole communicates with the pigment storage cavity.

2. The model-making toy capable of stepping out 3D models according to claim 1, wherein the tread surface is integrally formed with a plurality of friction beans, and the plurality of friction beans are arranged at intervals on the tread surface.

3. The model-making toy capable of stepping out 3D models according to claim 1, wherein the connecting structure comprises a blocking protrusion arranged on the tread surface, and the blocking protrusion is provided with a tape threading hole.

4. The model-making toy capable of stepping out 3D models according to claim 3, wherein the blocking protrusion comprises a first protrusion at one end of the toy sole body and two second protrusions at the other end of the toy sole body; the first protrusion is provided with a first tape threading hole, and the second protrusion is provided with a second tape threading hole.

5. The model-making toy capable of stepping out 3D models according to claim 1, wherein the ground-touching surface is provided with a plurality of friction grooves, and the friction grooves are arranged at intervals on the ground-touching surface.

6. The model-making toy capable of stepping out 3D models according to claim 1, wherein the tread surface is provided with a flow guiding slope, and the flow guiding slope is provided with a liquid inlet connected to the pigment storage cavity.

7. The model-making toy capable of stepping out 3D models according to claim 1, wherein the toy sole body is provided with a pressure sensing unit and a sounding unit inside used for sounding to remind that a 3D model has been formed.

8. A method for stepping out 3D models applied to the model-making toy capable of stepping out 3D models, wherein the method comprises the following steps:

abutting step: abutting a 3D molding groove against a molding material, wherein a pigment storage cavity is arranged inside a toy sole body, the 3D molding groove is provided with a connecting through hole, and the connecting through hole communicates with the pigment storage cavity;

molding step: applying a molding pressure to a tread surface to move the toy sole body toward the molding material, so that the molding material forms a model in the 3D molding groove; and demolding step: moving the toy sole body away from the molding material to expose a model.

9. The method according to claim 8, wherein the molding step comprises a shaping step and a pressing step;

in the shaping step, a force is applied to the tread surface, and the toy sole body moves toward a molding material so that the molding material fills into the 3D molding groove; and in the pressing step, a force is continuously applied to the tread surface, so that the 3D molding groove can press the molding material to form a model.

10. The method according to claim 9, wherein the pigment storage cavity is arranged inside the toy sole body, the pressing step further comprises a coloring process, and in the coloring process, the pigment storage cavity adds a pigment to the model.

11. The method according to claim 8, wherein the toy sole body is provided with a pressure sensor and a sounding unit; the pressure sensor is used for detecting a value of the molding pressure, and when the value of the molding pressure is greater than a set threshold, the sounding unit emits a warning sound.

12. A model-making toy capable of stepping out 3D models, comprising a toy sole body, wherein an upper surface of the toy sole body is provided with a tread surface and the toy sole body is provided with a 3D molding protrusion on a side opposite to the tread surface; and the toy sole body is provided with a connecting structure for assembling the model-making toy to a shoe bottom;

wherein a pigment storage cavity is arranged inside the toy sole body, the 3D molding protrusion is provided with a connecting through hole, and the connecting through hole communicates with the pigment storage cavity.

13. The model-making toy capable of stepping out 3D models according to claim 12, wherein the connecting structure comprises a blocking protrusion arranged on the tread surface, and the blocking protrusion is provided with a tape threading hole.

14. A method for stepping out 3D models applied to a model-making toy capable of stepping out 3D models, comprising:

abutting step: abutting a 3D molding protrusion against molding material, wherein a pigment storage cavity is arranged inside a toy sole body, the 3D molding protrusion is provided with a connecting through hole, and the connecting through hole communicates with the pigment storage cavity;

molding step: applying a molding pressure to a tread surface to move the toy sole body toward the molding material, so that the 3D molding protrusion forms a model in the molding material; and demolding step: moving the toy sole body away from the molding material to expose a model.

15. The method according to claim 14, wherein the molding step comprises a shaping step and a pressing step;

in the shaping step, a force is applied to the tread surface and the toy sole body moves toward the molding material so that the 3D molding protrusion is embedded into the molding material; and in the pressing step, a force is continuously applied to the tread surface, so that the 3D molding protrusion can press the molding material to form a model.

16. The method according to claim 14, wherein the pigment storage cavity is arranged inside the toy sole body, the pressing step further comprises a coloring process, and in the coloring process, the pigment storage cavity adds a pigment to the model.

17. The method according to claim 14, wherein the toy sole body is provided with a pressure sensor and a sounding unit; the pressure sensor is used for detecting a value of the molding pressure, and when the value of the molding pressure is greater than a set threshold, the sounding unit emits a warning sound.

* * * * *